US005799885A

United States Patent [19]

Karra

[11] Patent Number: 5,799,885

[45] Date of Patent: Sep. 1, 1998

[54] HIGH REDUCTION RATIO CRUSHING IN CONICAL/GYRATORY CRUSHERS

[75] Inventor: Vijia Kumar Karra, Franklin, Wis.

[73] Assignee: Nordberg, Inc., Wis.

[21] Appl. No.: 754,924

[22] Filed: Nov. 22, 1996

[51] Int. Cl.[6] ..... B02C 2/04

[52] U.S. Cl. ..... 241/30; 241/207

[58] Field of Search ..... 241/207–216, 241/264, 265, 202, 30

[56] References Cited

U.S. PATENT DOCUMENTS

| | | | |
|---|---|---|---|
| 4,359,208 | 11/1982 | Kelm et al. . | |
| 4,384,684 | 5/1983 | Karra . | |
| 4,560,113 | 12/1985 | Szalanski . | |
| 4,575,014 | 3/1986 | Szalanski et al. . | |
| 4,620,185 | 10/1986 | Plahmer . | |
| 4,658,638 | 4/1987 | Plahmer . | |
| 4,659,026 | 4/1987 | Krause et al. . | |
| 4,756,484 | 7/1988 | Bechler et al. . | |
| 4,956,078 | 9/1990 | Magerowski et al. . | |
| 5,029,761 | 7/1991 | Bechler . | |
| 5,172,869 | 12/1992 | Kitsukawa et al. | 241/265 |

FOREIGN PATENT DOCUMENTS

| | | | |
|---|---|---|---|
| 0003955 | 1/1979 | Japan | 241/202 |
| 0003853 | 1/1980 | Japan | 241/209 |

*Primary Examiner*—Mark Rosenbaum
*Attorney, Agent, or Firm*—Foley & Lardner

[57] ABSTRACT

The residence time of material in the crushing cavity of a conical/gyratory crusher is controlled by providing the crusher with a flow restricting arrangement at the lower end of the crushing surfaces. The flow restricting arrangement includes a frustum, ledges or ring of outwardly directed fingers provided at the lower end of the mantle, which finger are interspaced with inwardly directed fingers provided at the lower end of the bowl liner. The flow restricting arrangement also includes a solid ring or a frustum provided at the lower end of the mantle.

12 Claims, 4 Drawing Sheets

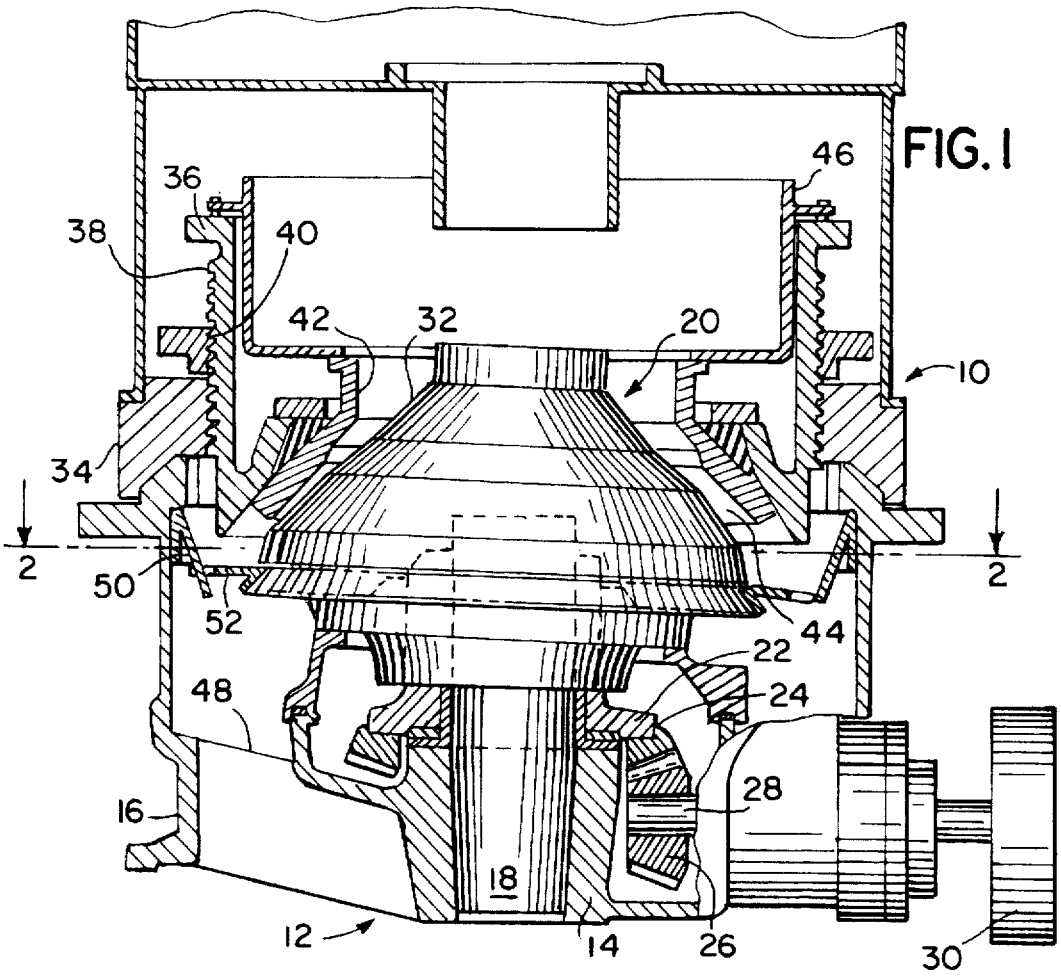
FIG. 1
FIG. 3
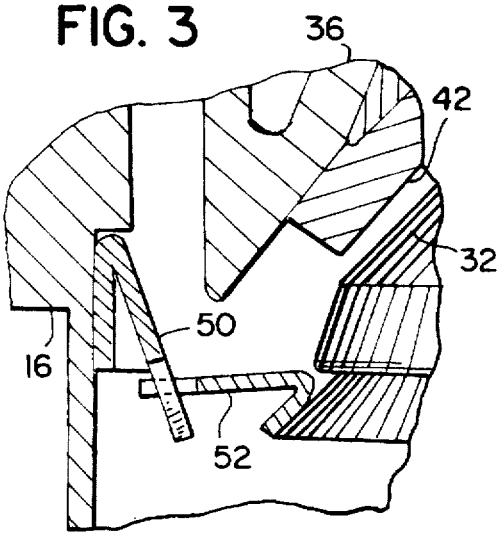
FIG. 4
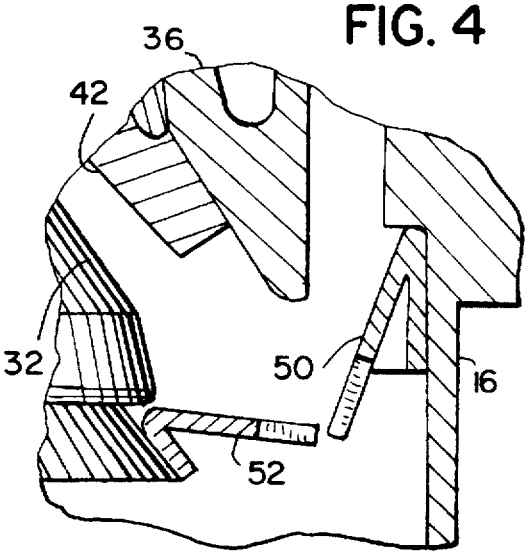

FIG. 6
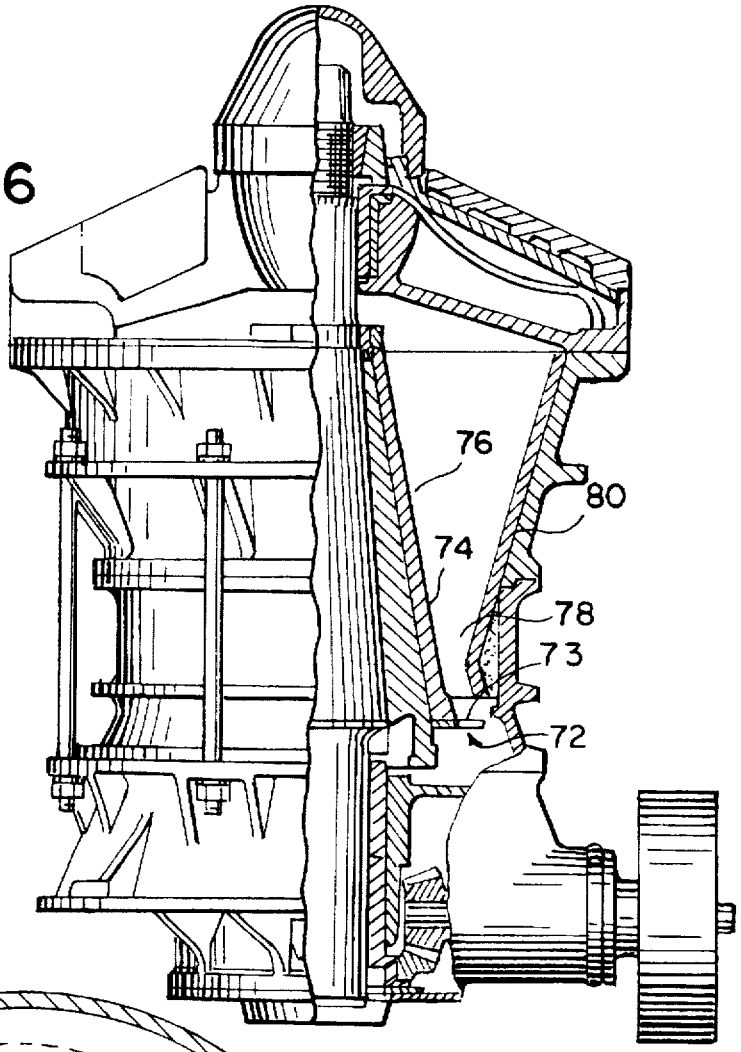
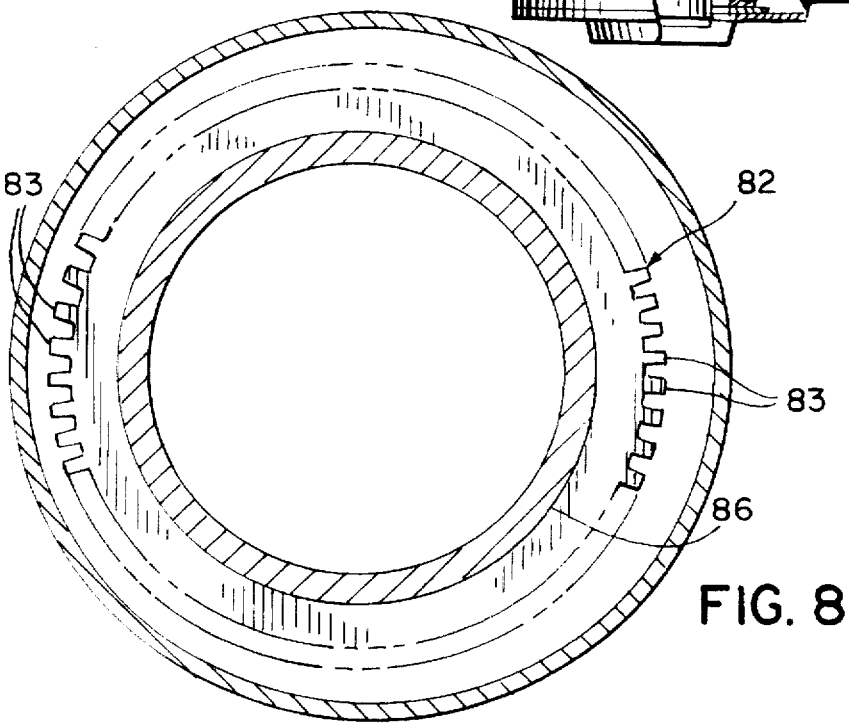
FIG. 8

FIG. 7
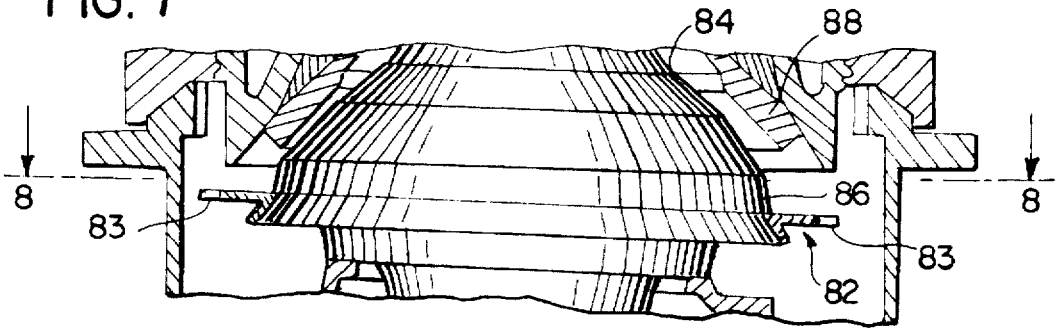
FIG. 9
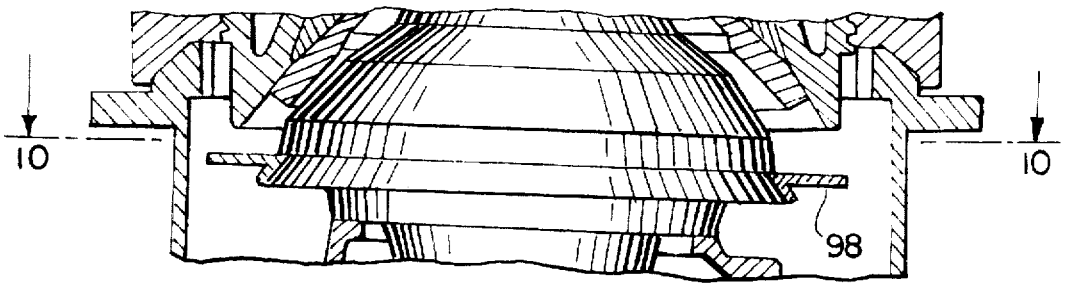
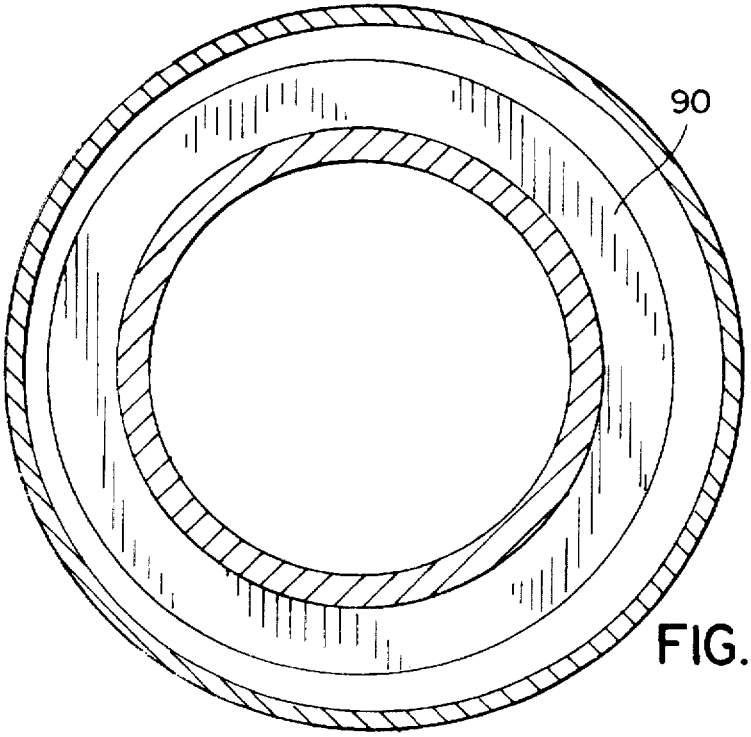
FIG. 10

HIGH REDUCTION RATIO CRUSHING IN CONICAL/GYRATORY CRUSHERS

CROSS REFERENCE TO RELATED APPLICATIONS

The present application is related to U.S. patent application Ser. No. 08/754,854, filed on an even date herewith, by Karra, entitled, "Conical Gyratory Grinding And Crushing Apparatus; and U.S. patent application Ser. No. 08/754,925, filed on an even date herewith, by Karra, entitled, "Conical Gyratory Mill For Fine Or Regrinding".

FIELD OF THE INVENTION

The present invention generally relates to conical or gyratory type crushers. More specifically, the present invention relates to increasing the reduction ratio in such crushers.

BACKGROUND OF THE INVENTION

Conical crushers having head assemblies which are caused to gyrate by an eccentric mechanism, driven by various rotary power sources, are commonly available and have been the subject of numerous prior patents. A conical crusher is typically constructed with a base member having a central hub surrounded by an annular shell on which is mounted for vertical movement an annular ring. A conical crusher bowl, which is typically provided with a liner, is mounted on the annular ring. A conical head assembly, which is also typically provided with a liner, commonly referred to as a mantle, is supported by a bearing mechanism on a stationary shaft supported by the central hub. An eccentric, mounted for rotation about the stationary shaft, provides gyration of the conical head assembly relative to the crusher bowl. By adjusting the vertical height of the crusher bowl with respect to the conical head, the crushing cavity or space between the bowl liner and the mantle may be adjusted to determine the particle size to which the material is crushed. Alternatively, a conical crusher or gyratory crusher can be configured as a GYRADISC® or other crusher. In such a crusher the crushing head can move vertically with respect to a bowl assembly to effect the crushing operation.

A ratio comparison of the size of the feed material to the crusher and the crushed product size of the material is referred to as the reduction ratio. Typically, 80 percent passing size or 50 percent passing size is used. Although the reduction ratio could be 6 60 1 or more, a typical one should be about 3 to 1.

Typically, in accordance with the prior art, to achieve a higher reduction ratio in a conical or gyratory crusher, tighter crusher settings are necessary (that is, decreased spacing between the facing surfaces of the bowl liner and the mantle). The downward movement of material to be crushed in the crusher cavity is primarily controlled by gravity (besides rock feed characteristics). However, it is also influenced by the angle of the conical head or mantle, the angle of the bowl liner, and displacement dynamics, such as eccentric throw and speed. Achieving high reduction ratios by tight settings, that is by close spacing of the bowl liner and the mantle can result in packing conditions in the bottom zone of the crushing cavity. This may result in lifting of the bowl liner or vertical downward movement of the head or mantle. While methods have been developed for avoiding packing conditions which result in pad formation, such as in WATER-FLUSH® crushing, tight settings are nevertheless needed to achieve satisfactory reduction ratios.

Therefore, it is desirable to provide a crusher which achieves high reduction ratios at coarser settings, that is with less close spacing of the bowl liner and mantle. There is a need to effectively control the residence time in the crushing cavity between the bowl liner and the mantle of the material being crushed to achieve high reduction ratios. The reliance on increased residence time to achieve high reduction ratios by causing more "rock-on-rock" interaction, that is, interparticle comminution of the material to be crushed, advantageously allows the crushing cavity to be set at a relatively coarse setting.

SUMMARY OF THE INVENTION

In accordance with this invention higher reduction ratios are provided in conical/gyratory crushers by regulating the residence time in the crushing cavity of the material to be crushed, by controlling the rate and size of material particles discharge from the crushing cavity.

The present invention relates to a mechanical arrangement for use in a rock crusher having a first crushing surface and a second crushing surface. The first and second crushing surfaces have upper and lower ends. The first and second crushing surfaces are spaced from each other so as to form a crushing space there between in which a material may be crushed. The second crushing surface is movable with respect to the first crushing surface so as to crush the material passing downward through the crushing space. The mechanical arrangement includes a first crushed material retaining member disposed at the lower end of the first crushing surface and a second crushed material retaining member disposed at the lower end of the second crushing surface. The first and second crushed material retaining members restrict the flow of the material from the crushing space between the lower ends of the first and second crushing surfaces so as to delay the passage of the material to be crushed from the crushing space.

The present invention further relates to a mechanical device for use in a conical/gyratory crusher having a conical crusher bowl surrounding a conical crusher head which gyrates with respect to the conical crusher bowl. The crusher bowl and crusher head have upper and lower ends. The crusher bowl and the crusher head are spaced from each other so as to form an annular crushing space there between in which a material may be crushed. The crusher head is movable with respect to the crusher bowl so as to crush a material passing downward through the crushing space. The mechanical device includes a crushed material retaining structure at the lower end of the crushing space. The crushed material retaining structure extends below the crushing space and restricts the flow of the crushed material from the crushing space between the lower ends of the crusher bowl and the crusher head so as to delay the passage of the material being crushed from the crushing space, whereby it is more finely crushed before being discharged from the crushing space.

The present invention still further relates to a method of crushing material in a rock crusher including a bowl and a conical head. A crushing space is defined by the bowl and the conical head. The method includes steps of feeding the material into the crushing space, moving the conical head with respect to the bowl to form a crushed material from the material in the crushing space, and physically retaining the crushed material in the crushing space with a retaining member to delay the exit of the crushed material from the crushing space.

Advantages of the residence time control of this invention are crushing stage consolidation, reliability, and significant lowering of comminution costs for like weights of material crushed. By providing residence time control in accordance with this invention, primary crushers will provide a greater reduction ratio, which may be followed by secondary crushers of high reduction ratio with or without water flushing. Such a high productivity two-stage approach will outperform autogenous mill based comminution methods. Crushers will be able to perform high reduction ratio work at coarser settings, with larger throws, and at slower speeds, without unduly excessive forces being generated in the crusher components. Increased inter-particle contact and grinding results in more fines and enhanced liberation of the valuable constituents in the crusher discharge material. Crusher designs employing the arrangement for residence time control of this invention will exhibit significantly lower cost with a higher reduction ratio.

In accordance with this invention, residence time regulation, through crushed material discharge rate and size control, may be obtained by providing a conical/gyratory type crusher with a crushed material retaining structure in the form of a stationary ring or frustum of inwardly directed fingers at the lower edge of the crushing surface of the crusher bowl liner, and a ring or frustum of outwardly directed fingers at the lower edge of the crushing surface of the mantle. The two sets of fingers are interspaced so as to permit free movement of the moving fingers of the ring or frustum at the lower edge of the mantle with respect to the fixed fingers at the lower edge of the crusher bowl liner. This construction serves to prevent spinning of the head or mantle with respect to the crusher bowl. However, an additional spin restraining mechanism may be desirable. The relative movement between the fixed fingers at the lower edge of the crusher bowl and the moving fingers at the lower edge of the mantle generally prevents the formation of blockages in the spaces between the fingers. The fingered structures are made of suitable wear resistant materials.

In an alternate embodiment of this invention, a finger structure is only provided on the bottom edge of the mantle, in which case the head can be permitted to rotate with respect to the crusher bowl. The fingers may be covered by a suitable elastomeric wear material. In still another embodiment of this invention, a finger structure is not provided on the lower edge of the crusher bowl, and the finger structure attached to the lower edge of the mantle or head is replaced by a solid circular plate forming a ledge. In still another embodiment, a finger or ledge structure is not provided at the lower edge of the mantle, and the finger structure at the lower edge of the bowl liner is replaced by a solid circular plate forming a ledge.

In yet another aspect of the present invention, the mantle and bowl liner or crushing surface need not be machined and can be as cast surfaces. The retaining members hold the material and allow crushing even though the crushing surfaces are further spaced apart. The crushing is controlled by contact of crushed particles rather than spacing of crushed surfaces.

BRIEF DESCRIPTION OF THE DRAWINGS

FIG. 1 is a cross-sectional view of a conical/gyratory crusher provided with residence time regulation employing a frustum of inwardly directed fingers below the lower edge of the crusher bowl liner, and a ring of outwardly directed fingers below the lower edge of the mantle in accordance with a first embodiment of this invention.

FIG. 3 is an enlarged cross-sectional view of the inwardly directed fingers of the frustum below the lower edge of the crusher bowl liner, and of the outwardly directed fingers of the ring below the lower edge of the mantle on the left side of the crusher taken along the line 3—3 in FIG. 2.

FIG. 4 is an enlarged cross-sectional view of the inwardly directed fingers of the frustum below the lower edge of the crusher bowl liner, and of the outwardly directed fingers of the ring below the lower edge of the mantle on the right side of the crusher taken along the line 4—4 in FIG. 2.

FIG. 6 is a cross-sectional view of a conical/gyratory crusher provided with residence time regulation employing a ring of outwardly directed fingers below the lower edge of the mantle in accordance with a third embodiment of this invention.

FIG. 7 is an enlarged cross-sectional view of the lower edge of the mantle and the ring of outwardly directed fingers of the third embodiment of this invention as shown in FIG. 6.

FIG. 8 is a cross-sectional view taken along the line 8—8 in FIG. 7.

FIG. 9 is a cross-sectional view similar to FIG. 7, wherein residence time regulation is provide in a conical/gyratory crusher by circular plate ledge located below the lower edge of the mantle in accordance with a fourth embodiment of this invention.

FIG. 10 is a cross-sectional view taken along the line 10—10 in FIG. 9.

DETAILED DESCRIPTION OF THE PREFERRED EMBODIMENTS

Figure 2:
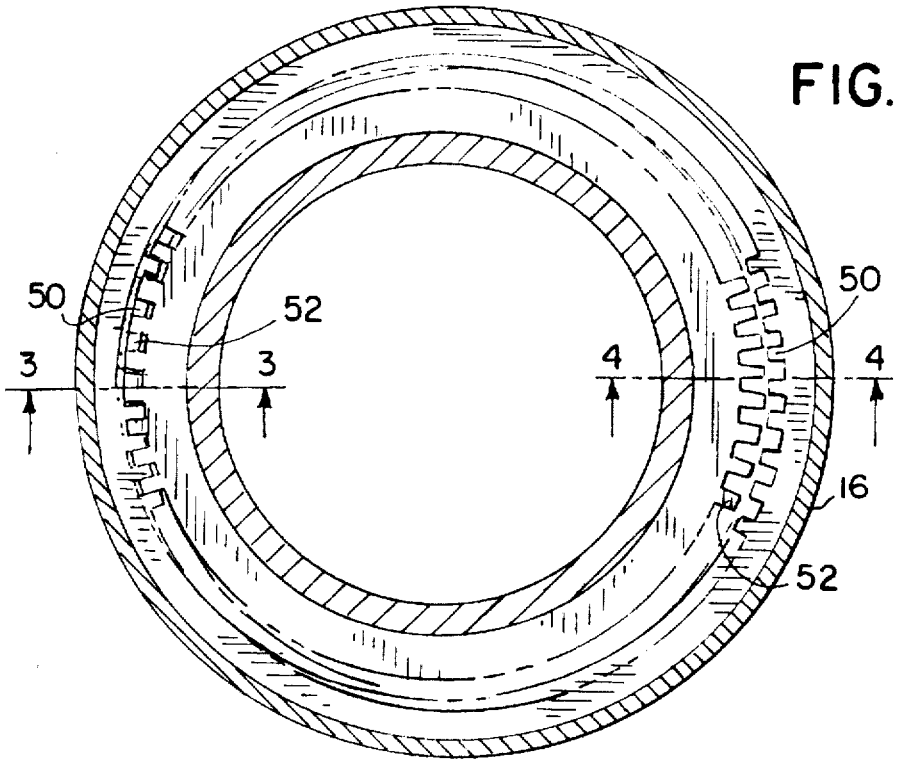
FIG. 2 is a cross-sectional view taken along the line 2—2 in FIG. 1 showing the inwardly directed fingers of the frustum below the lower edge of the crusher bowl liner, and the outwardly directed fingers of the ring at or below the lower edge of the mantle.

Referring to FIGS. 1 through 4, a first embodiment of a conical/gyratory crusher provided with residence time control of the material to be crushed in the crushing cavity between the crusher bowl liner and the mantle will be described. A crusher 10 is assembled on a base member 12 having a central hub 14 surrounded by an annular shell 16. The central hub 14 supports a stationary shaft 18 which in turn supports a crusher head 20 through a hemispherical bearing (not shown). The crusher head 20 is caused to wobble or gyrate by an eccentric 22 which rotates about stationary shaft 18. The eccentric 22 is dynamically balanced about its center of rotation by a counter weight. The eccentric 22 is provided with a gear 24 which is driven by a spur gear 26 carried on a shaft 28, which is in turn driven by a prime mover (not shown) coupled by a belt to a pulley 30. A bearing arrangement is provided between the crusher head 20 and the eccentric 22, such that the eccentric 22 can rotate within the crusher head 20 without causing its rotation. A liner or mantle 32, formed of a suitable wear resistant material is provided on the outer surface of the crusher head 20.

Supported on the annular shell 16 is an annular ring 34, which in turn supports a conical crusher bowl 36. The crusher bowl 36 and the annular ring 34 are provided with mating threads 38 and 40 respectively, whereby the vertical position of the crusher bowl 36 is adjustable with respect to the base member 12 and therefor, the crusher head 20. The crusher bowl 36 is provided with a liner 42 formed of a suitable wear resistant material. The liner 42 is positioned adjacent the mantle 32 to form an annular crushing cavity or space 44 therebetween. While the width of the crushing cavity 44 varies as the eccentric 22 causes the crusher head to wobble, the crushing cavity 44 generally decreases in cross-section from top to bottom. A cylindrical container 46 is provided for receiving and dispensing to the annular crushing cavity 44 the material to be crushed. The crushed material which exits from the lower end of the crushing cavity 44 falls through opening 48 in the base member 12 to a collection area.

In accordance with a first embodiment of this invention, the residence time of the material to be crushed in the crushing cavity 44 is controlled by providing a retention structure in the form of a frustum of fingers 50 supported on the annular shell 16, projecting inwardly and downwardly below the lower edge of conical crusher bowl 36, and a ring of fingers 52 supported on the crusher head 20, projecting outwardly below the lower edge of mantle 32. The frustum of fingers 50 and the ring of fingers 52 are shown in greater detail in FIGS. 3 and 4.

As seen in FIGS. 1 and 2, as the crusher head 20 gyrates within the crusher bowl 36, on the side where the bowl liner 42 and mantle 32 are closest together, the fingers 50 and 52 are interspaced to a significant extent, while on the side where the bowl liner 42 and mantle 32 are the farthest apart, the finger tips are closely adjacent to each other, but are not interspaced. Alternatively, fingers 50 and 52 can be replaced with a grate-like or ledge-like structure. Thus, crushed material builds up on top of the fingers 50 and 52, thereby increasing the retention time of the material to be crushed between the bowl liner 42 and the mantle 32. The radial movement of the fingers 50 and 52 with respect to each other serves to dislodge the material resting thereon such that it passes through the opening 48 to the collection area. Thus, fingers 50 and 52 delay the discharge of crushed material and yet remove blockages which may form at the lower edge of mantle 32 due to the movement of fingers 52 with respect to fingers 50.

The dimensions of the fingers 50 and 52 are chosen to provide the desired regulation of residence time. The width of the space between the fingers, as compared to the finger width of a finger received in the space, the extent to which the base of one set of teeth is moved away from the tips of the other set of teeth at the widest separation of the lower edge of the crushing space, and the width of the teeth, which in turn determines the number of spaces between the teeth, may all be considered and specifically determined to provide the desired residence time. While the retention structure must necessarily permit the crushed material to pass therethrough, delaying its passage will result in additional crushing between the crusher bowl liner 42 and the mantle 32. Further, additional inter-particle crushing will occur as the material is retained and accumulated between the crushing members. The fingers 50 and 52 being in continued engagement with the crushed material, and to some extend contributing to the crushing of the material as it passes between the teeth, should be formed of a material which is suitably wear resistant and tough, such as manganese or other robust material.

When a retaining structure is provided in accordance with this invention, as set forth above, it may be desirable that a mechanism be provided, other than the engagement of the two sets of teeth, to prevent the crusher head 20 from turning with respect to the bowl 36. Alternatively, a fixed retaining structure which does not move with respect to bowl liner 42 can be utilized. The retaining structure can be fixed to the main frame or threaded to the bowl within the path of discharged material.

Figure 5:
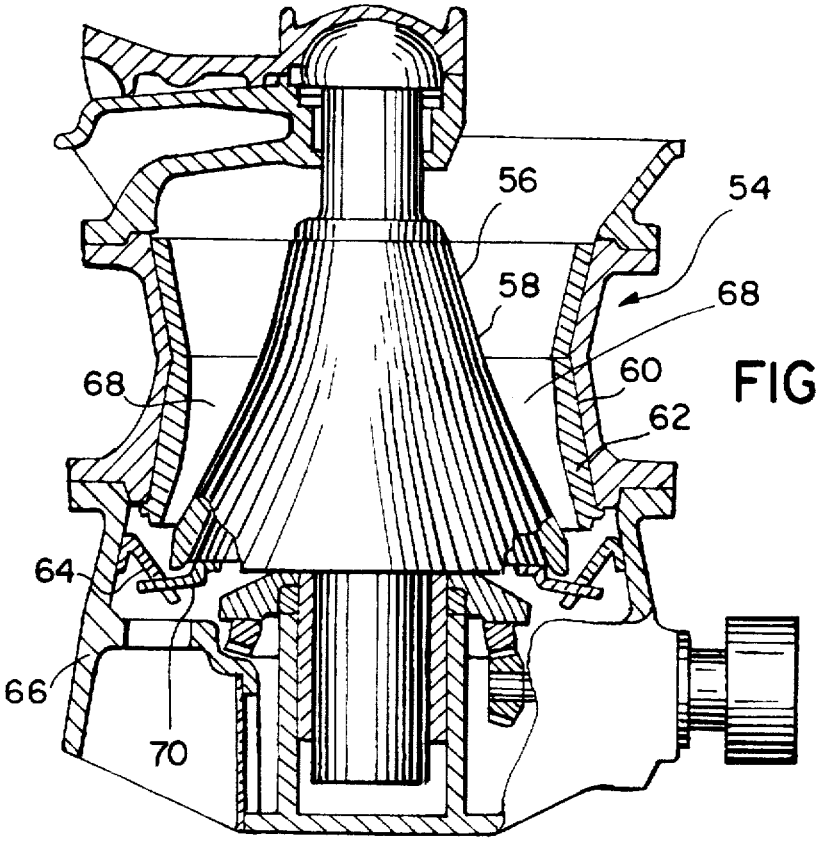
FIG. 5 is a cross-sectional view of a conical/gyratory crusher provided with residence time regulation employing a frustum of inwardly directed fingers below the lower edge of the crusher bowl liner, and a frustum of outwardly directed fingers below the lower edge of the mantle in accordance with a second embodiment of this invention.

Referring to FIG. 5, a second embodiment of this invention as a gyratory crusher is shown. While the crusher 54 shown in FIG. 5 is of a different general construction from that shown in FIGS. 1–4, it is similar in having a crusher head provided with a mantle 58, and a conical crusher bowl 60 provided with a liner 62. As in the first embodiment a retaining structure in accordance with this invention includes a frustum of fingers 64 supported on annular shell 66 so as to be positioned below the liner 62 and to extend below the crushing space 68 toward the crusher head 56. Instead of a ring of fingers extending from the crusher head 56 as in the first embodiment, a second frustum of fingers 70 is supported on the crusher head 56, extending toward the annular shell 66 below the crushing space 68. As in the first embodiment, the fingers of the first and second frustums are interspaced with each other. To provide the desired retention time the same factors should be considered in designing the retention structure in this second embodiment as are considered in the first embodiment.

A third embodiment of this invention is illustrated in FIG. 6. In this embodiment, regulation of residence time is provided by a retention structure including a toothed ring 72 provided at the lower end of mantle 74 of crusher head 76. As in the prior embodiments, the toothed ring delays the passage of the crushed material from crushing space 78, thus causing further crushing of the material between the mantle 74 and a bowl liner 80. The delay in passage of the crushed material through the crushing space 78 also results in additional interparticle crushing.

A fourth embodiment of this invention is shown in FIGS. 7 and 8. This embodiment is quite similar to that illustrated in FIG. 6, in that it also employs a toothed ring 82 supported on the crusher head 84 located at the lower edge of mantle 86. However, the mantle 86 and bowl liner 88 as shown in FIGS. 7 and 8 are of a different configuration than that shown in FIG. 6.

A fifth embodiment of this invention is shown in FIGS. 9 and 10. The configuration of the crusher shown in this embodiment is the same as that of the fourth embodiment shown in FIGS. 7 and 8. However, in this embodiment a solid ring 90, rather than a toothed ring is employed to delay the passage of the crushed material from the crushing space, thereby regulating the residence time in the crushing space. The solid ring could be provided with a suitable height upward projecting ledge on the ring periphery for building of crushed material for autogenous wear protection of the top surface of the ring.

While several embodiments, of the invention have been shown, it should be apparent to those skilled in the art that what have been described are considered at present to be the preferred embodiments of this invention. In accordance with the Patent Statute, changes may be made in the structures provided to increase residence time in the crushing zone of a conical/gyratory type crusher without actually departing from the true spirit and scope of this invention. The appended claims are intended to cover all such changes and modifications which fall in the true spirit and scope of this invention.

What is claimed is:

1. In a crusher having a first crushing surface and a second crushing surface moveable with respect to the first crushing surface, the first and second crushing surfaces having upper and lower ends, the first and second crushing surfaces being spaced from each other so as to form a crushing space therebetween in which a material may be crushed, the crushing space being wider between the upper ends of the crushing surfaces than between the lower ends, a mechanism for moving the second crushing surface with respect to the first crushing surface, such that at any given location between the first and second crushing surfaces the distance between the crushing surfaces varies, so as to crush a material passing downward through the crushing space, an arrangement for increasing the reduction ratio capability of the crusher comprising a first crushed material retaining member at the lower end of the first crushing surface and a second crushed material retaining member at the lower end of the second crushing surface, said first crushed material retaining member extending downwardly at an angle in the form of a frustum below the crushing space and cooperating with the second crushed material retaining member to restrict the flow of crushed material from the crushing space between the lower ends of the first and second crushing surfaces, so as to delay the passage of the material being crushed from the crushing space, whereby the material is more finely crushed before being discharged from the crushing space.

2. The arrangement for increasing the reduction ratio capability of the crusher of claim 1, wherein said first and second crushed material retaining members are each formed with a plurality of spaced teeth extending below the crushing space.

3. The arrangement for increasing the reduction ratio capability of the crusher of claim 2, wherein said plurality of spaced teeth of said first and second crushed material retaining members are interspaced with each other.

4. The arrangement for increasing the reduction ratio capability of the crusher of claim 4, wherein said plurality of spaced teeth of said first and second crushed material retaining members are interspaced with each other.

5. The arrangement for increasing the reduction ratio capability of the crusher of claim 1, wherein the second crushed material retaining member is a generally horizontal member extending below the crushing space.

6. The arrangement for increasing the reduction ratio capability of the crusher of claim 5, wherein said generally horizontal member is formed with a plurality of spaced teeth extending below the crushing space.

7. A mechanical device for use in a conical/gyratory crusher having a conical crusher bowl surrounding a conical crusher head which gyrates with respect to the conical crusher bowl, the crusher bowl and crusher head having upper and lower ends, the crusher bowl and the crusher head being spaced from each other so as to form an annular crushing space therebetween in which a material may be crushed, the crusher head being movable with respect to the crusher bowl so as to crush a material passing downward through the crushing space, the mechanical device comprising:

a first crushed material retaining member at the lower end of the crusher bowl, said first crushed material retaining member extending downwardly at an angle in the form of a frustum below the crushing spaces; and a second crushed material retaining member at the lower end of the crusher head and extending below the crushing space, the first and second crushed material retaining members restricting the flow of crushed material from the crushing space between the lower ends of the crusher bowl and crusher head, so as to delay the passage of the material being crushed from the crushing space, whereby the material is more finely crushed before being discharged from the crushing space.

8. The mechanical device of claim 7, wherein said first and second crushed material retaining members are each formed with a plurality of spaced teeth extending below the crushing space.

9. The mechanical device of claim 8, wherein said plurality of spaced teeth of said first and second crushed material retaining members are interspaced with each other.

10. A method of crushing material in a rock crusher including a bowl and a conical head, a crushing space being defined by the bowl and the conical head, the method comprising the steps of:

feeding a material into the crushing space;

moving the conical head with respect to the bowl to form a crushed material from the material in the crushing space; and physically retaining the crushed material in the crushing space with first and second retaining members to delay the exit of the crushed material from the crushing space, the first retaining member being attached at a lower end of the bowl and extending downwardly at an angle in the form of a frustum below the crushing space, the second retaining member being attached at a lower end of the conical head.

11. The method of claim 10, wherein at least one of the first and second retaining members includes a plurality of ledges or fingers.

12. The method of claim 10, wherein the crushed material is physically retained by ledges or fingers below the bowl and conical head and is coated with wear resistant plastic elastomeric.

* * * * *